US005205266A

United States Patent [19]

Kilby, Jr.

[11] Patent Number: 5,205,266

[45] Date of Patent: Apr. 27, 1993

[54] RUBBER BAND PROJECTILE TOY GUN

[76] Inventor: A. Harold Kilby, Jr., Rte. 3, Box FM75, Tuttle, Okla. 73089

[21] Appl. No.: 884,825

[22] Filed: May 18, 1992

[51] Int. Cl.[5] ..... F41B 7/02

[52] U.S. Cl. ..... 124/19; 124/35.1

[58] Field of Search ..... 124/18, 19, 35.1, 31

[56] References Cited

U.S. PATENT DOCUMENTS

| | | | |
|---|---|---|---|
| 1,724,708 | 8/1929 | Harris | 124/19 |
| 2,550,873 | 5/1951 | Siders | 124/19 |
| 2,689,558 | 9/1954 | Sealer et al. | 124/19 |
| 2,741,238 | 4/1956 | Arnold | 124/19 |
| 2,917,037 | 12/1959 | Henderson | 124/19 |
| 3,919,996 | 11/1975 | McAlister | 124/19 |
| 4,949,494 | 8/1990 | Mims | 42/54 |

FOREIGN PATENT DOCUMENTS

| | | | |
|---|---|---|---|
| 339544 | 12/1930 | United Kingdom | 124/19 |

*Primary Examiner*—Randolph A. Reese
*Assistant Examiner*—John Ricci
*Attorney, Agent, or Firm*—Robert K. Rhea

[57] ABSTRACT

A repeating rubber projectile firing toy gun is formed by a hollow handle and frame portion integrally connected with a gun barrel portion. A sprocket wheel magazine journalled by opposing side walls of the frame section projects above the gun frame for receiving one end portion of a rubber band, having its other end portion engaged over a notch at the forward end of the gun barrel. A trigger mechanism biases a spring urged pawl out of engagement with the sprocket wheel to permit angular rotation thereof and release at least one of the projectiles while a second pawl on the trigger mechanism interrupts the sprocket wheel rotation after the release of only one rubber band projectile or a succession of rubber band projectiles by repeated trigger pulls.

4 Claims, 2 Drawing Sheets

RUBBER BAND PROJECTILE TOY GUN

BACKGROUND OF THE INVENTION

1. Field of the Invention

This invention relates to guns and more particularly to a toy gun utilizing rubber bands as the ammunition.

Primarily, this invention provides a toy gun which has the capability of firing a plurality of elasticized bands either singularly or in rapid succession with each loading operation.

2. Description of the Prior Art

U.S. Pat. No. 4,949,494 issued Aug. 21, 1990 to Mims for Repeating Rubber Band Pistol is believed to be the most pertinent prior patent which describes a repeating rubber band pistol having a frame, a barrel and a handle. A recess in the handle journals a wheel-like rotary magazine on a horizontal axis. A plurality of rubber bands are stretched between a barrel notch and a respective one of the arms of the magazine. A trigger element mounted in the frame recess successively engages and releases magazine arms and rubber bands thereon by a rocking motion of the trigger element.

Other prior patents generally disclose toy guns which feature a succession of longitudinally spaced upstanding notches or elements singularly receiving one end portion of an elasticized band. U.S. Pat. No. 3,919,996 issued Nov. 18, 1975 to McAlister for Repeating Self Projecting Band Type Apparatus is believed to be a good example of the state of such art. This patent discloses a repeating rubber band rifle wherein a plurality of stretched elastic members are sequentially released by a slide mechanism that individually permits rotation of upstanding studs successively releasing rubber bands to a firing position.

This invention is believed to be distinctive over the above named and other similar patents by the configuration of its sprocket wheel magazine and trigger control release thereof.

SUMMARY OF THE INVENTION

The gun comprises a generally hollow rearward stock portion integral with an intermediate hollow frame portion having an integral barrel portion projecting forwardly therefrom.

The frame portion has an opening in its top wall for exposing the spokes of a sprocket wheel journalled between opposing side walls of the frame on a horizontal axis.

The gun sight of the forward end of the barrel is provided with a notch receiving one end portion of a rubber band with its other end engaging one of the spokes of the sprocket wheel.

Manual movement of a trigger mechanism similarly pivotally supported between the frame side walls actuate a pair of pawls for permitting angular rotation of the sprocket wheel by the biasing action of the rubber band or bands engaged therewith.

The principal object of this invention is to provide a toy gun for firing rubber band projectiles in a single or repeating fashion without reloading and to provide a clip containing a reserve of rubber band ammunition.

DESCRIPTION OF THE PREFERRED EMBODIMENTS

Figure 1:
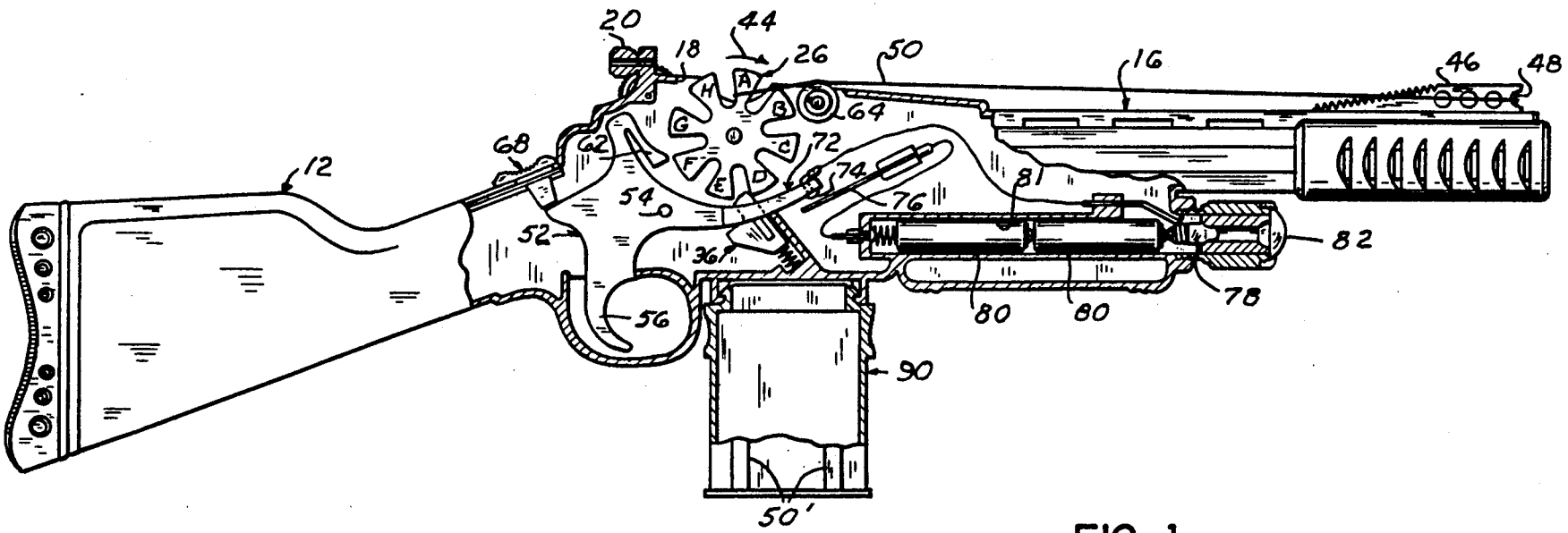
FIG. 1 is a side elevational view with parts broken away for clarity.

Like characters of reference designate like parts in those figures of the drawings in which they occur.

In the drawings:

The reference numeral 10 indicates the gun as a whole which is rifle-like in general configuration.

The gun comprises a hollow handle portion 12, an intermediate frame hollow portion 14, all integrally connected with the forward gun barrel portion 16.

The frame portion 14 has an opening 18 in its top wall disposed forwardly of the rear sight 20.

The side walls 22 of the frame portion, only one being shown, transversely support an axle 24 which journals a sprocket wheel 26.

A peripheral portion of the sprocket wheel 26 projects upwardly above the upper limit of a concave recess 28 formed in each frame side wall upper edge portion for manually grasping the uppermost spoke of the sprocket wheel for loading as presently explained.

The sprocket wheel 26 is characterized by a plurality (8) of radially disposed parallel wall U-shaped slots 30 projecting substantially half the radial distance between the perimeter of the sprocket wheel and its center.

The U-shaped recesses or slots 30 thus define a like plurality of 45° spaced sprocket wheel spokes A, B, C, D, E, F, G and H in which the circumferential dimension of the respective spoke is substantially twice the dimension between the inner ends of any two adjacent slots 30.

In side elevation, each of the spokes 32 is substantially fan-shaped to insure retention of one end of a rubber band when placed in a respective slot as presently explained.

An upward and rearwardly inclined stub partition 34 projects upwardly from the lower limit of the frame portion 14 to form a stabilizing wall slidably accommodating a pawl 36 having an elongated slot 38 parallel with the stub partition 34 which cooperatively receives a side wall 22 supported guide 39 permitting movement toward and away from the sprocket wheel by an expansion spring 40 interposed between the downward end surface of the pawl and a cooperating socket formed in the bottom wall of the frame 14.

The transverse forward to rearward dimension of the upper end portion of the pawl is greater than the transverse width of a any one of the slots 30 to prevent complete entry of the pawl into the respective slot.

A portion of the top end surface of the pawl 36 is angularly inclined downwardly and rearwardly as at 42 for the purpose presently explained.

The purpose of the pawl 36 being to partially enter the adjacent slot 30 and engage one of the spokes to prevent angular rotation of the sprocket wheel in the direction of the firing arrow 44, except as authorized as presently explained.

The forward end portion of the barrel 16 is provided with a front sight 46 having a vertical notch or recess 48 in its forward end portion which receives one end of an elastic band 50. The other end of the band is manually pulled rearwardly and engaged by the wall of the uppermost sprocket wheel slot 30 and held in this position by the spoke A until released by the operator as presently explained.

A trigger mechanism 52, plate-like in general configuration, is supported for rocking motion about a horizontal pivot pin 54 supported by the opposing walls 22 of the frame portion.

The trigger mechanism includes an arcuate trigger portion 56, within a trigger guard 58, and a forwardly projecting leg 60.

The forward end of the trigger leg 60 contacts a shoulder on the pawl 36 to bias the pawl downwardly against the spring 40 when the trigger 56 is pulled rearwardly. This permits the resilience of the rubber band 50 to angularly rotate the sprocket wheel 26 in the direction of the firing arrow 44 and release the rubber band 50 as a projectile.

This action is interrupted by a second pawl 62 integrally projecting downwardly and forwardly toward the sprocket wheel axle 24 from the upper limit of the trigger mechanism 52.

The depending end portion of the second pawl 62 normally contacts the peripheral end surface of the adjacent spoke. When the sprocket wheel is released by the pawl 36 the resiliency of the pawl 62 biasing it toward the periphery of the sprocket wheel 26 urges the depending end portion of the pawl 62 into the first slot 30 approaching the pawl 62. During the rotation of the sprocket wheel, as just described, wherein the pawl 62 enters a slot 30 and interrupts the rotation of the sprocket wheel, the pawl 36 is held out of engagement with a sprocket wheel spoke by the trigger leg 60.

When the trigger 56 is manually released, the pawl spring 40 urging the pawl 36 upwardly into the adjacent slot 30, also biases the trigger leg 60 upwardly and the second pawl 62 in a rearward sprocket wheel released direction while the pawl 36 stops wheel rotation in the direction of the firing arrow 44.

An anti-friction roller 64 is journalled on a transverse pin 66 forwardly of the sprocket wheel 26 with a peripheral portion of the roller 34 projecting above the upper limit of the frame portion 14 to ensure freedom of movement of the rubber band 50 when released from the sprocket wheel.

A safety lock 68 is slidably supported by the stock 12 and includes a depending portion 70 in which its lowermost end contacts a rearwardly projecting shoulder portion of the trigger mechanism 52 (FIG. 1) to prevent accidentally pulling the trigger and firing one or more of the rubber bands 50.

The trigger assembly 52 further includes a switch arm 72 which is a lateral and forward extension of the trigger arm 60. At its forward end the switch arm 72 supports one contact 74 of an electric switch closed with its companion contact 76 when the trigger 56 is pulled to energize a lamp 78 by batteries 80 in a barrel portion battery compartment 81. A lamp lens 82 projects a spot light beam, not shown, on the target at the time of firing the gun.

The gun assembly 10 further includes an ammunition magazine 90 comprising an upwardly open receptacle having outstanding ring-like ribs 92 on its upper end which is cooperatively received by annular grooves in a short wall 94 depending from the rifle frame 14 for storing a plurality of additional rubber bands 50', only two being shown (FIG. 1), for use after firing rubber bands contained by the sprocket wheel 26.

OPERATION

Operation seems obvious from the above description, but briefly stated; the gun is loaded with a plurality of the rubber bands 50, one for each of the sprocket slots 30. This is done by placing one end of a rubber band in the front sight notch 48, manually stretching it rearwardly and placing its other end portion within an upwardly open unoccupied slot 30 (between spokes A and H) with the rubber band extending across the roller 64. The sprocket wheel 26 is then manually rotated one spoke position rearwardly, in the direction of the loading arrow 95, in which the peripheral surface of the sprocket wheel spoke E contacts the pawl end surface 42 to bias the pawl 36 downwardly against its spring 40 and permit passage of the sprocket spoke E and allow the pawl 36 to engage the next adjacent sprocket slot 30 (between the spokes E and F). Simultaneously, the peripheral surface of the spoke G forces the pawl 62 out of the circumferential travel path of the sprocket wheel.

This action is repeated with additional rubber bands, not shown, one for each of the sprocket wheel slots 30.

Figure 2:
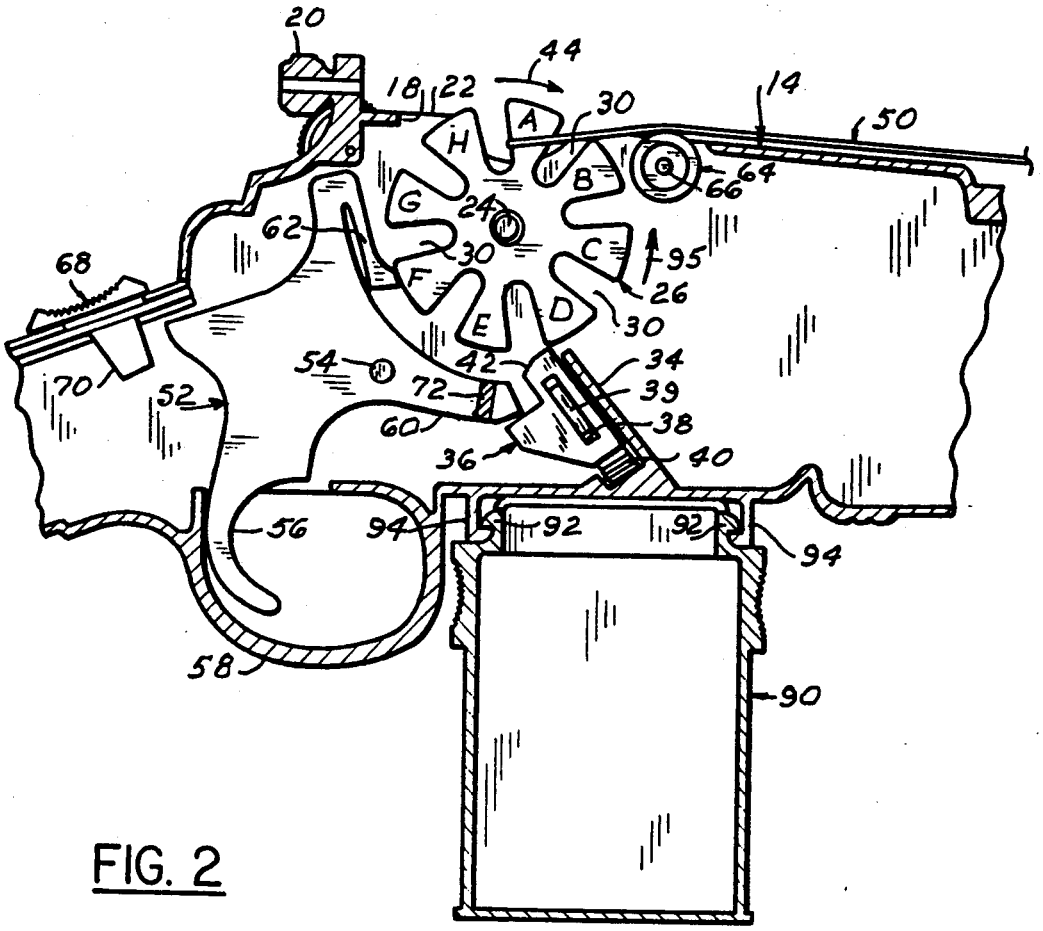
FIG. 2 is a fragmentary side elevational view, similar to FIG. 1 to a larger scale, and illustrating the gun in firing position; and, FIG. 3 is a view similar to FIG. 2 illustrating the trigger stopped position of the sprocket wheel after releasing one projectile.

The gun is released to firing position by moving the safety latch 68 to a rearward position (FIG. 2) and pulling the trigger 56.

Figure 3:
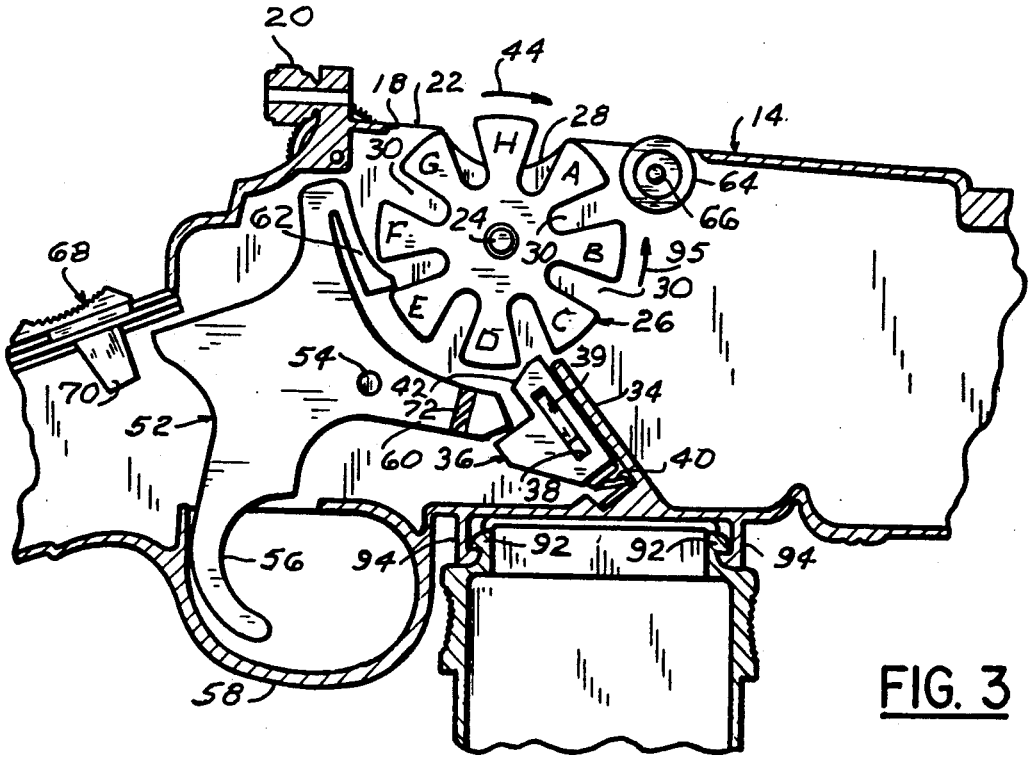

The switch arm 72 closes its contacts 74 and 76 and illuminates the lamp 78 while simultaneously the trigger leg 60 biases the pawl 36 downwardly against its spring to release the sprocket wheel for angular rotation in the direction of the firing arrow 44 a distance of one spoke position movement. The position of the pawl 36 relative to the wheel is such that when the pawl 36 is contacting an adjacent spoke the walls defining the side of the uppermost slot 30 are at least vertical but preferably slightly inclined rearwardly as in FIG. 1. This insures maintaining the "ready to be fired" band 50 in its slot 30 and that the 45° arc of rotation is sufficient to incline the slot walls toward the barrel 16 when the trigger is pulled, as shown in the band fired position of FIG. 3. The second pawl 62 engages the adjacent sprocket spoke E to stop angular rotation of the sprocket wheel which completes one cycle of operation.

Obviously the trigger can be repeatedly pulled to fire all eight of the loaded rubber bands.

It similarly seems obvious that the gun may be made in pistol fashion by changing the configuration of its handle 12 and shortening its barrel portion 16.

Obviously the invention is susceptible to changes or alterations without defeating its practicability. Therefore, I do not wish to be confined to the preferred embodiment shown in the drawings and described herein.

I claim:

1. A toy gun, comprising:

a hollow gun frame defined by opposing side walls having an elongated top opening and having a stock portion at its handle end and a barrel with a front sight at its forward portion, the sight having a forward recess for engaging one end of a rubber band;

a sprocket wheel journalled by an axle extending transversely between the frame side walls, the sprocket wheel being characterized by a plurality of parallel wall U-shaped radially disposed rubber band receiving slots defining a like plurality of substantially fan-shaped wheel spokes for respectively engaging the opposite ends of a like plurality of rubber bands stretched between the front sight recess and respective slots in readiness for firing and preventing premature release of a rubber band being fired until the side walls of a slot containing the rubber band are inclined toward the gun barrel;

first pawl means projecting into a sprocket wheel slot for normally maintaining said sprocket wheel in rubber band firing position;

trigger means including a second pawl pivotally supported between the frame walls for biasing said first pawl means out of the slot and biasing the second pawl into sprocket wheel rotation limiting stopped position; and, a roller transversely journalled between the frame side walls adjacent the upward forward limit of the circumferential travel path of said sprocket wheel with the peripheral portion of the roller projecting above the upper limit of said frame for supporting an intermediate portion of a rubber band stretched between the front sight recess and a sprocket wheel spoke.

2. The toy gun according to claim 1 in which the first pawl means comprises:

a first pawl slidably supported by said frame for movement toward and away from said sprocket wheel; and, resilient means normally biasing said first pawl toward said sprocket wheel.

3. The toy gun according to claim 2 and further including:

spot light means including a lamp connected by wiring with a source of electrical energy for illuminating a target; and, a switch interposed in the wiring.

4. The toy gun according to claim 3 and further including:

switch arm means integral with said trigger means for closing and opening said switch in response to trigger movement.

* * * * *